US010281251B2

(12) United States Patent
Jackson

(10) Patent No.: US 10,281,251 B2
(45) Date of Patent: May 7, 2019

(54) NON-LETHAL ARROW ENTERTAINMENT SYSTEM AND KIT

(71) Applicant: John Jackson, Ashley, IN (US)

(72) Inventor: John Jackson, Ashley, IN (US)

(73) Assignee: Global Archery Products, Inc, Ashley, IN (US)

( * ) Notice: Subject to any disclaimer, the term of this patent is extended or adjusted under 35 U.S.C. 154(b) by 0 days.

(21) Appl. No.: 15/841,410

(22) Filed: Dec. 14, 2017

(65) Prior Publication Data

US 2019/0041177 A1 Feb. 7, 2019

Related U.S. Application Data

(63) Continuation-in-part of application No. 15/670,059, filed on Aug. 7, 2017, now abandoned.

(51) Int. Cl.

| | |
|---|---|
| ***F42B 6/08*** | (2006.01) |
| ***F42B 12/40*** | (2006.01) |
| ***F42B 6/04*** | (2006.01) |

(52) U.S. Cl.

CPC ..... *F42B 12/40* (2013.01); *F42B 6/04* (2013.01); *F42B 6/08* (2013.01)

(58) Field of Classification Search

CPC ..... F42B 6/08; A63B 43/005; A63B 2208/12; A63B 2244/04

USPC ..... 473/573, 582; 102/502; 446/473

See application file for complete search history.

(56) References Cited

U.S. PATENT DOCUMENTS

| | | | | |
|---|---|---|---|---|
| 4,166,618 | A * | 9/1979 | Sheem | A63B 65/122 124/23.1 |
| 2010/0207330 | A1* | 8/2010 | Yaroch | A63F 9/0204 273/358 |
| 2014/0323252 | A1* | 10/2014 | Lennon | F42B 6/08 473/582 |
| 2016/0038830 | A1* | 2/2016 | Merchant | A63F 9/34 473/582 |
| 2016/0187109 | A1* | 6/2016 | Cummings | F42B 6/02 473/582 |

* cited by examiner

*Primary Examiner* — J. Woodrow Eldred

(74) *Attorney, Agent, or Firm* — Indiano & McConnell LLC

(57) ABSTRACT

A non-lethal arrow that includes a shaft having a non-lethal arrow assembly on a respective end of the shaft. A nock is connected to an opposite end of the shaft. A plurality of vanes is connected to the shaft near the nock. A marker can be attached to an end of the non-lethal arrow assembly that is configured to stick to a target upon impact with the target. The marker is further configured such that the non-lethal arrow disengages from the marker, and falls away from the target upon impact with the target leaving only the marker left on the target.

9 Claims, 13 Drawing Sheets

NON-LETHAL ARROW ENTERTAINMENT SYSTEM AND KIT

RELATED APPLICATION

The present application is a continuation-in-part and claims priority to U.S. patent application Ser. No. 15/670,059 filed on Aug. 7, 2017, which is incorporated by reference herein in its entirety.

BACKGROUND OF THE INVENTION

Field of the Invention

The present invention relates to a non-lethal arrow entertainment system and kit including non-lethal arrows having markers.

Description of the Related Art

Many different types of arrows have been designed over the years to shoot at targets and animals. Most are lethal arrows that are shot at targets such as a bale of hay with some type of target attached to it for example. This type of target practice can be somewhat unsafe, especially for children or beginners. The present invention addresses a need in the market for a safe arrow target system.

SUMMARY OF THE INVENTION

One aspect of the present invention discloses anon-lethal arrow that includes a shaft having a non-lethal arrow assembly on a respective end of the shaft. A nock is connected to an opposite end of the shaft. A plurality of vanes is connected to the shaft near the nock. A marker can be attached to an end of the non-lethal arrow assembly that is configured to stick to a target upon impact with the target. The marker is further configured such that the non-lethal arrow disengages from the marker and falls away from the target upon impact with the target leaving only the marker left on the target. The marker includes a disc portion that includes a metal pad and an end of the non-lethal arrow assembly includes a magnetic pad that allows the marker to be removably secured to the end of the non-lethal arrow assembly.

In one form, the non-lethal arrow assembly comprises a foam tip and the marker is attached to an end of the foam tip. The foam tip is secured to the shaft by a blunt. The marker includes an adhesive layer that allows the marker to stick to a target. In one form, the adhesive layer comprises a hook fastener of a hook and loop fastener. In another form, the adhesive layer could comprise a loop fastener of a hook and loop fastener.

Another form of the present invention discloses a non-lethal arrow that includes a shaft having a blunt on a respective end of the shaft. A nock is connected to an opposite end of the shaft. A plurality of vanes is connected to the shaft near the nock. A magnetic pad is connected to an end of the blunt.

A marker is configured to be removably attached to the magnetic pad. The marker includes a disc portion and a metal pad, wherein the metal pad is configured to connect with the magnetic pad. The disc portion includes an adhesive layer that is operable to stick the marker to a target when the non-lethal arrow is shot at the target.

A foam tip can be configured to be removably connected to an end of the blunt. The foam tip includes a metal pad in an end of the foam tip, wherein the metal pad is operable to connect the foam tip to the end of the blunt. In another form, the foam tip includes a pressure sensitive adhesive in an end of the foam tip, wherein the pressure sensitive adhesive is operable to connect the foam tip to the end of the blunt. In another form, a marker that includes a metal pad that is used to secure the marker to the magnetic pad and a foam tip that includes a metal pad that is used to secure the foam tip to the magnetic pad. The marker and the foam tip can be interchangeably connected to the magnetic pad thereby providing a multi-use non-lethal arrow.

Another aspect of the present invention discloses a non-lethal arrow that includes a shaft having a blunt on a respective end of the shaft. The blunt includes a magnetic insert on an end of the blunt. A nock is connected to an opposite end of the shaft and a plurality of vanes is connected to the shaft near the nock. A marker is included that includes a disc portion and an adhesive layer on one side of the disc portion. The marker is configured to be removably attached to the magnetic insert on the end of the blunt such that when the non-lethal arrow hits a target only the marker sticks to the target.

The marker includes an aperture running through the adhesive layer and the disc portion. The disc portion includes a metal member on an opposite side of the disc portion from the adhesive layer. The marker is operable to removably be connected to the end of the blunt by inserting the aperture onto the magnetic insert whereby the metal member secures the marker to the magnetic insert.

A further aspect of the present invention discloses a kit that includes one or more bows and a target. The kit also includes one or more non-lethal arrows. The non-lethal arrows include a shaft having a blunt on a respective end of the shaft. A nock is connected to an, opposite end of the shaft. A plurality of vanes is connected to the shaft near the nock. A marker is attached to an end of the blunt that is configured to stick to the target upon impact with the. The marker is further configured such that the non-lethal arrow disengages from the marker and falls away from the target upon impact with the target leaving only the marker on the target. The marker includes a disc portion that includes a metal pad and an end of the blunt includes a magnetic pad that allows the marker to be removably secured to the end of the blunt. In yet another faint, the end of the blunt could include a hook and loop portion that would allow the arrow itself to stick to the target.

BRIEF DESCRIPTION OF THE DRAWINGS

The description herein makes reference to the accompanying drawings wherein like reference numerals refer to like parts throughout the several views, and wherein.

DETAILED DESCRIPTION OF THE INVENTION

Figure 1:
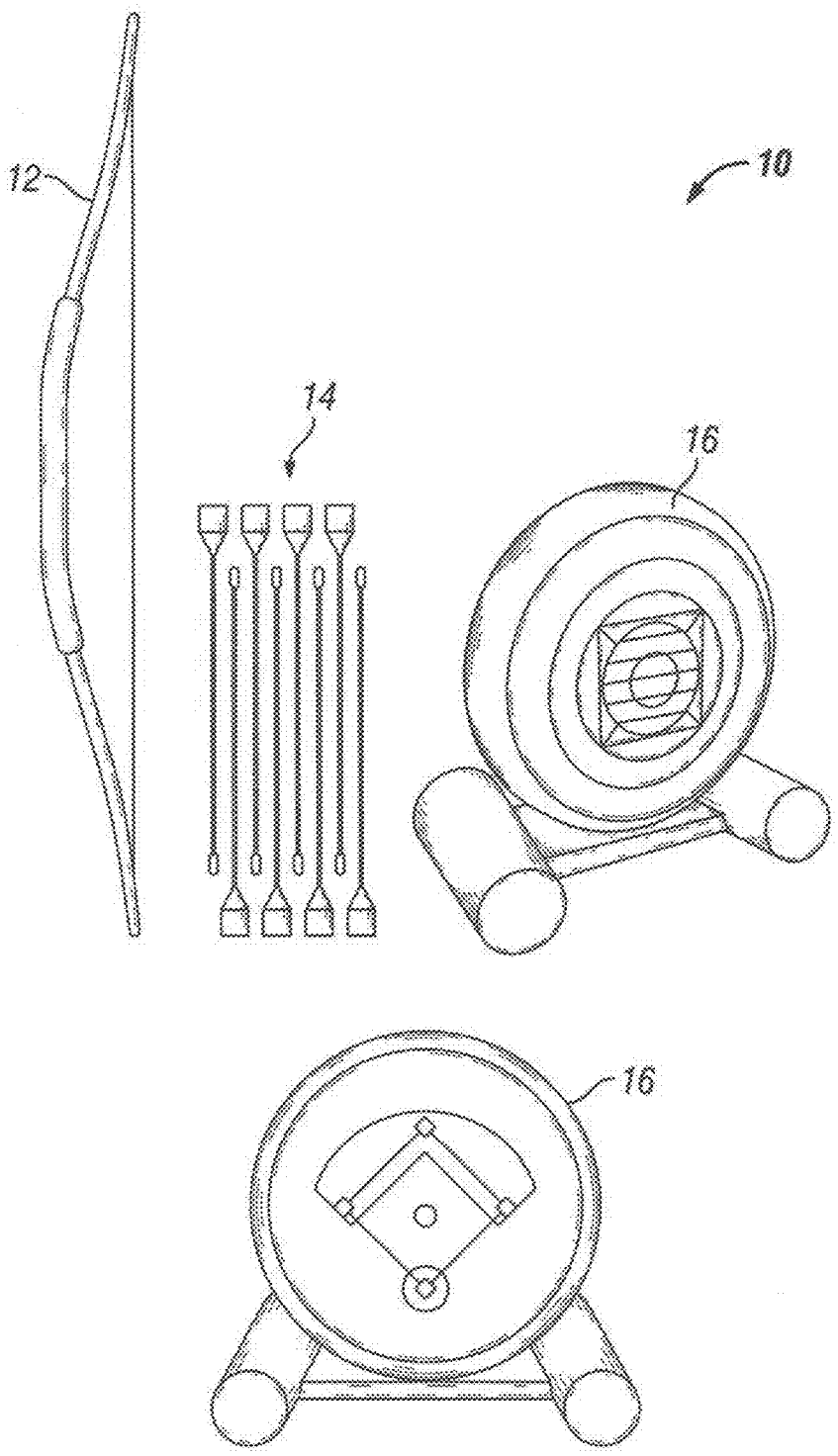
FIG. 1 discloses a non-lethal arrow entertainment system and kit.

For purposes of promoting an understanding of the principles of the invention, reference will now be made to the embodiments illustrated in the drawings and specific language will be used to describe the same. It will nevertheless be understood that no limitation of the scope of the invention is thereby intended, any alterations and further modifications in the illustrated devices or systems, and any further applications of the principles of the invention as illustrated therein being, contemplated as would normally occur to one skilled in the art to which the invention relates.

Referring to FIG. 1, a non-lethal arrow entertainment system 10 is disclosed that, in some embodiments, can come in the form of a kit. The non-lethal arrow entertainment system 10 includes one or more bows 12, a plurality of non-lethal arrows 14, and a target 16. As illustrated, the target 16 is reversible and can have a traditional target on it and different game-type targets on it. In the illustrated form, the target 16 has a baseball type target game on one side, but it should be appreciated that various types of game-type targets can be used in the present invention. In the illustrated embodiment, the plurality of bows 12 comprise longbows. It should be appreciated that in other forms of the invention other types of bows 12 could be used such as, for example, recurve bows. As one skilled in the art would readily understand, the bows 12 are used to shoot the arrows 14 at the target 16.

Figure 2:
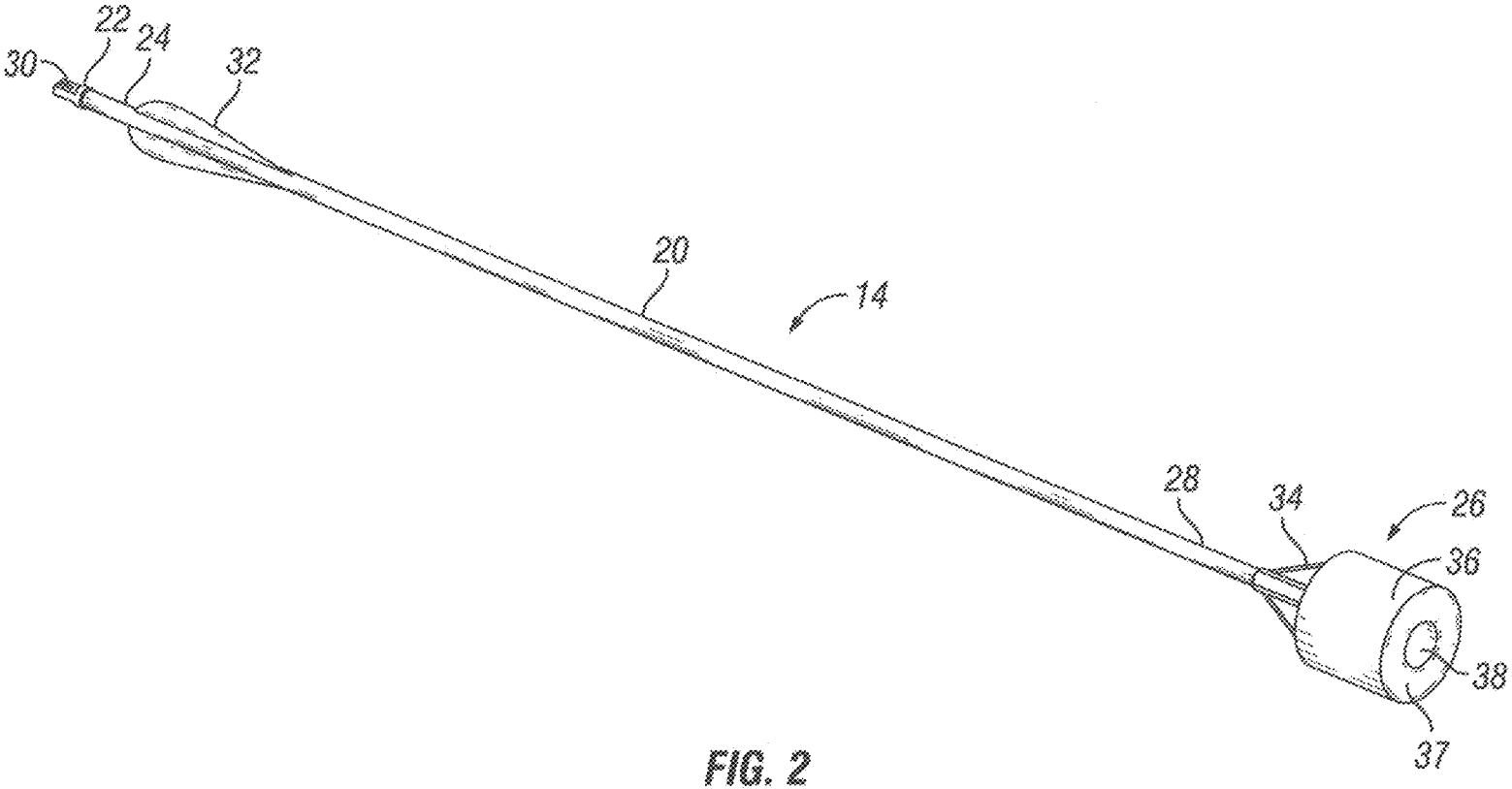
FIG. 2 discloses a non-lethal arrow.

Referring to FIG. 2, a non-lethal arrow 14 utilized in the present invention is set forth in greater detail. The non-lethal arrow 14 includes a shaft 20 extending along a longitudinal axis. A nock 22 is connected to a first end 24 of the shaft 20 and a non-lethal arrowhead assembly 26 is connected to a second end 28 of the shaft 20. The nock 22 includes a notch 30 that is utilized to secure a bowstring to the arrow 14. In addition, near the first end 24 of the shaft 20 is a fletching or vanes 32 that is attached or connected to the shaft 20. The fletching 32 is used to aerodynamically stabilize the arrow 14 and may be made from a plurality of materials such as synthetic polymer, feathers, or leather to name a few. In yet another form, the arrow 14 does not include fletching 32.

The non-lethal arrowhead assembly 26 includes a tip connector or blunt 34 and a foam tip 36. As illustrated, the foam tip 36 is connected to the blunt 34 and has a generally cylindrical shape. In the preferred embodiment, the foam tip 36 is made from a material that is relatively durable, yet soft, so that if someone is struck by the arrow 14 they are not injured upon impact from the arrow 14. In other forms, the foam tip 36 can have a spherical or hemispherical shape. In one form, the foam tips 36 can be glued onto the blunt 34 and in other forms the foam tips 36 can be screwed onto the blunt 34. For a more detailed description of the non-lethal arrow 14, refer to U.S. Pat. No. 8,932,159 and U.S. Pat. No. 8,449,413, both of which are incorporated by reference herein in their entirety.

Figure 3A:
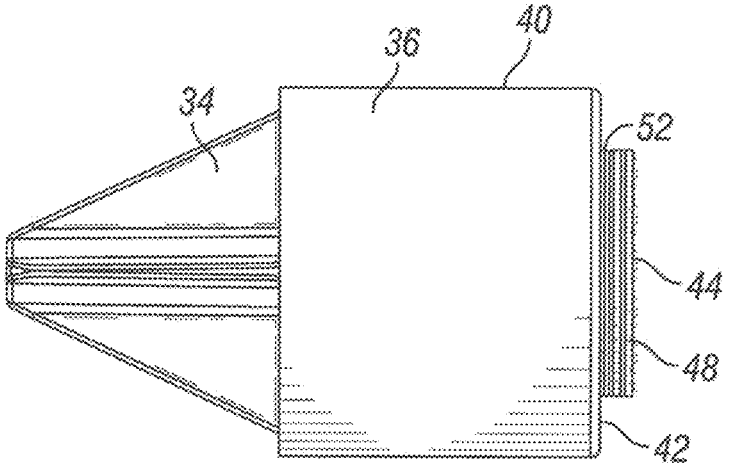
FIG. 3*a* discloses a side view of a foam tip of a representative non-lethal arrow.
Figure 3B:
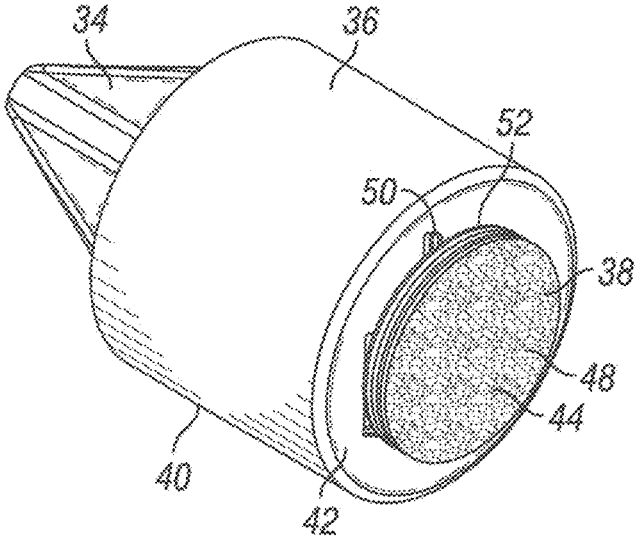
FIG. 3*b* discloses a perspective view of a foam tip of a representative non-lethal arrow.
Figure 4C:
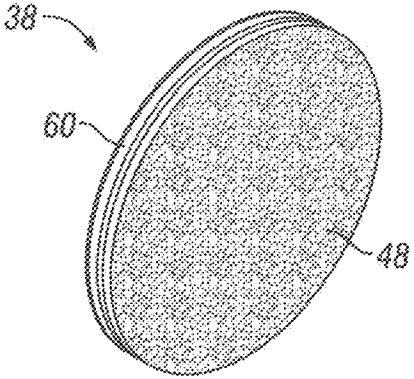
FIGS. 4*a*-4*d* discloses various views of a marker used with the non-lethal arrow.
Figure 4D:
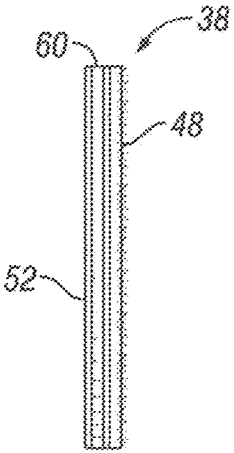
Figure 4A:
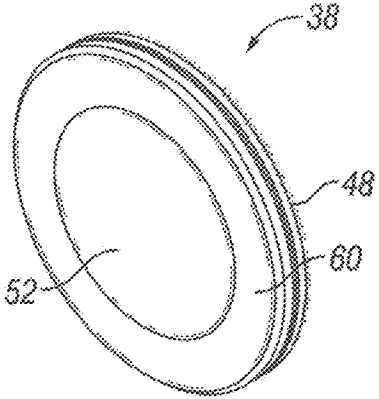
Figure 4B:
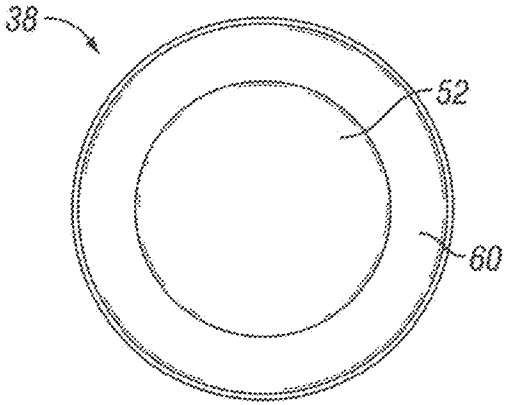

A front end 37 of the foam tip 36 includes a marker 38. Referring to FIGS. 3*a* and 3*b*, a more detailed view of the blunt 34, foam tip 36, and marker 38 are illustrated. As illustrated, the foam tip 36 includes an outer wall 40 and an upper wall 42. In one form, the foam tip 36 includes a hollow interior. The marker 38 is removably attached to the upper wall 42 of the foam tip 36. The marker 38 includes a generally cylindrical upper surface or portion 44. Although shown as cylindrical, it should be appreciated that the marker 38 could be made in various shapes. Attached to the upper portion 44 of the marker 38 is an adhesive layer 48. As set forth in greater detail below, the adhesive layer 48 is used to attach the marker 38 to the target 16 when the non-lethal arrow 14 strikes the target 16.

In one form, the adhesive layer 48 comprises the hook portion of a hook and loop fastener. In another form, the adhesive layer 48 comprises the loop portion of a hook and loop fastener. In yet another form, the adhesive layer 48 could comprise any type of sticky substance capable of sticking the marker 38 to the target 16. As further illustrated, the upper portion 42 of the foam tip 36 includes a magnet 50. A back portion of the marker 38 includes a metal disc 52 that is used to secure the marker 38 to the upper surface 42 of the foam tip 36. The marker 38 is thus removably secured to the magnet 50 in the foam tip 36.

Referring to FIGS. 4*a*-4*d*, more detailed views of the marker 38 is illustrated. The marker 38 includes a disc portion 60 that surrounds the metal disc or pad 52. The metal pad 52 is thus connected with the disc portion 60. The metal pad 52 could be glued to the disc portion 60 in some forms or formed as an integral part of the disc portion 60 in other forms. As illustrated, the adhesive layer 48 is connected with a respective side of the disc portion 60. The adhesive layer 48 is used to "stick" the marker 38 to the target 16. When the arrow 14 is shot at the target 16, it impacts the target 16 and the marker 38 sticks to the target 16 while the rest of the arrow 14 falls away to the ground. Thus, the only thing stuck to the target 16 is the marker 38.

Figure 5A:
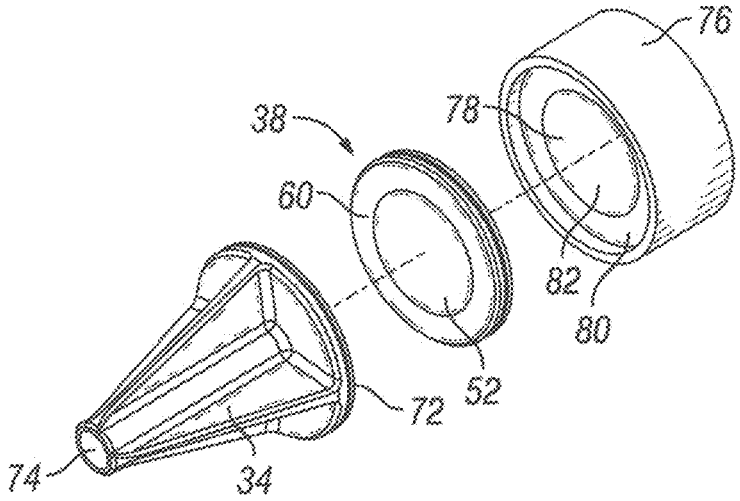
FIGS. 5*a*-5*d* discloses views of a multi-purpose non-lethal arrow.
Figure 5B:
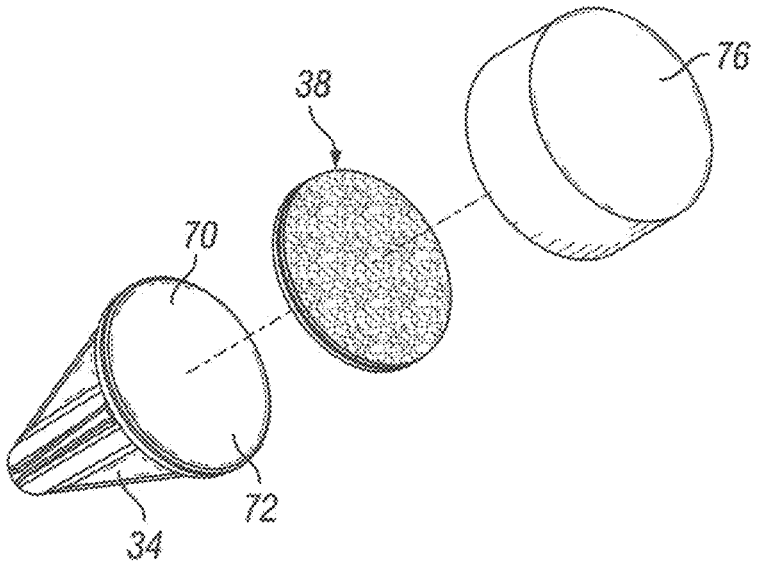

Referring to FIGS. 5*a* and 5*b*, yet another form of the present invention will be described. In this form, a multi-purpose arrow 14 is disclosed similar to that set forth in FIG. 2. In this form, an upper surface 70 of the blunt 34 includes a magnetic pad 72. A lower end of the blunt 34 includes an aperture 74 for receiving the shaft 20 (see FIG. 2). In this form, the marker 38 can be removably attached to the blunt 34 by sticking it to the magnetic pad 72 on the blunt 34. As such, the multi-purpose arrow 14 can be used to shoot at the target 18 and as set forth below can, also be used to play non-lethal combat archery.

In addition, a foam tip 76 can be removably secured to the end of the blunt 34. In this form, the foam tip 76 includes a metal pad 78 that can be secured to the magnetic pad 72 of the blunt 34. As illustrated, the foam tip 76 includes a recessed portion 80 that goes over and surrounds the end of the blunt 34. In yet another form, the foam tip 76 could include a pressure sensitive adhesive layer 82 instead of the metal pad 78. The pressure sensitive adhesive layer 82 could be used to removably secure the foam tip 76 to the end of the blunt 34. In yet another form, the foam tip 76 could include a hook or loop layer 82 instead of the metal pad 78 and would attach to the hook or loop (see FIG. 7*b*). The blunt 34 will have a magnet and the Velcro. As used herein Velcro refers to hook and loop fasteners. The marker 38 will have metal that is attracted to the blunt 34. The foam tip will have either metal, pressure sensitive adhesive, or Velcro to attach to the blunt 34. As such, the multi-purpose arrow 14 could be used to play non-lethal combat archery and to shoot at the target 18.

Figure 6:
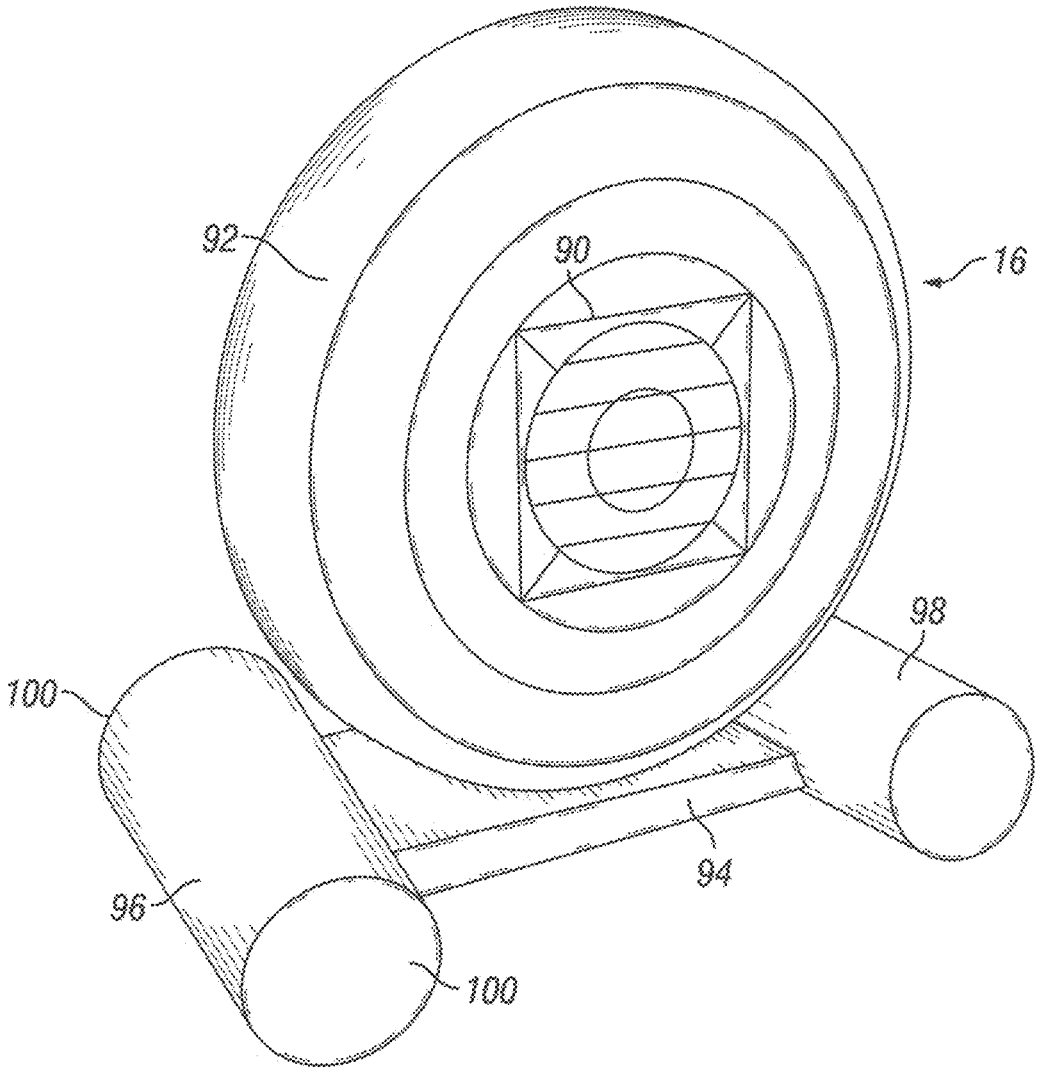
FIG. 6 discloses a target used with the non-lethal arrow entertainment system and kit.

Referring to FIG. 6, a more detailed discussion of one illustrative embodiment of a target 16 will be discussed. As illustrated, in this form, the target 16 comprises an inflatable target. In the illustrated form, the inflatable target 16 does not require continuous airflow to remain inflated, but in other forms it could require continuous airflow. The target 16 includes a target portion 90 attached to an outer portion 92. In one form, the target portion 90 is configured to be removably attached to the outer portion 92 such that different types of target portions 90 can be applied to the target 16. As previously discussed, another target portion 90 can be applied to the outer portion 92 on the reverse side of the target 16.

A lower portion of the outer surface 92 is connected with a base portion 94. First and second legs 96, 98 are connected with respective ends of the base portion 94. The base portion 94, first leg 96, and second leg 88 provide support for the target portion 90. A plurality of anchor members 100 are connected to a lower surface of the legs 96, 98. The anchor members 100 can be used to secure the target to the ground or to the bottom of a lake or body of water.

The target portion 90 of the target contains an adhesive layer 102. In one foul', the adhesive layer 102 comprises a hook portion of a hook and loop fastener, such as Velcro. In another form, the adhesive layer 102 comprises the loop portion of a hook and loop fastener. It should be appreciated that the adhesive layer 102 will be the opposite of the adhesive layer 44 used on the markers 38. This way, the markers 38 can stick to the target portion 90. As previously set forth, when the arrows 14 hit the target 16, the markers 38 stick to the target 16 and the arrows 14 fall to the ground thereby only leaving the marker 38 attached to the target 16.

Figure 7A:
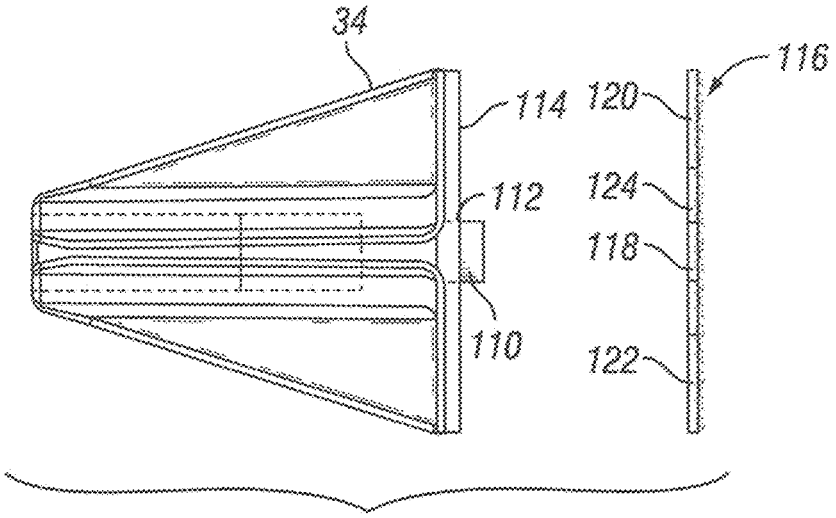
FIGS. 7*a*-7*b*; discloses views of another version of a blunt and marker for a non lethal arrow.
Figure 7B:
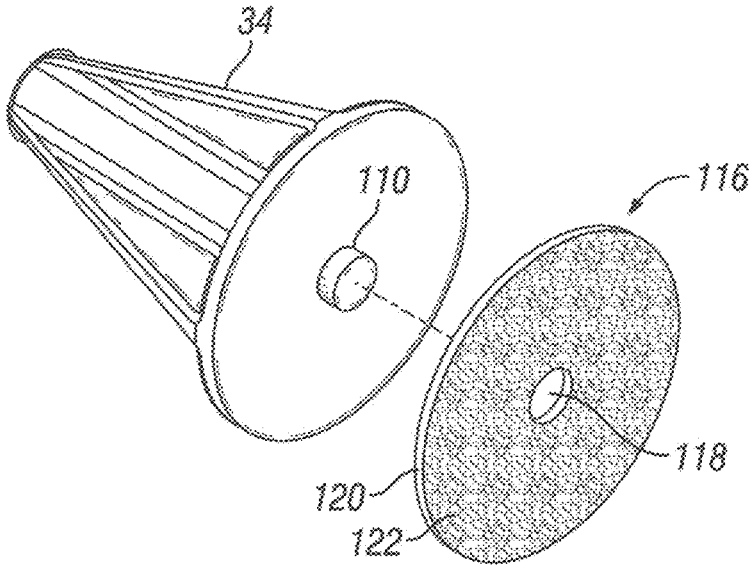

Referring to FIGS. 7*a*-7*b*, yet another form of a blunt 34 that may used with the non-lethal arrows 14 is disclosed. In this form, the blunt 34 includes a cylindrical magnetic insert 110. As illustrated, the magnetic insert 110 is positioned within an aperture 112 in a central portion of an end 114 of the blunt 34. A marker 116 is disclosed that includes an aperture 118 in a central portion of the marker 116 sized to slide over the magnetic insert 110.

The marker 116 includes a disc portion 120 to which an adhesive layer 122 is attached to one side. As with the other embodiments, the adhesive layer 122 can comprise a Velcro or hook and loop pad. The adhesive layer 122 needs to be compatible with the adhesive layer 102 of the target portion 90 of the target 16 such that the marker 116 sticks to the target portion 90 of the target 16. The disc portion 120 of the marker 116, as will all of the other markers disclosed herein, may be made from a polymer in some forms. A metal ring or member 124 is integrated into the disc portion 120 on a back side of the marker 116 opposite the adhesive layer 122.

During use, a shooter would slide the marker 116 onto the end 114 of the blunt 34. The aperture 118 in the marker 116 would slide around the magnetic insert 110. The metal ring 124 in the marker 116 would be attracted to the magnetic insert 110 thereby removably securing the marker 116 to the end 114 of the blunt 34. The shooter would then use the bow 12 to shoot the arrow 14 at the target 16. Upon striking the target portion 90 of the target 16, the marker 116 will stick to the target portion 90 and detach from the arrow 14 thereby allowing the arrow 14 to fall to the ground. This is advantageous because if the arrow 14 would stick to the target portion 90, it would block other shots with additional arrows.

In one form of the present invention, the disc portion 120 of the markers 116 can be made in different colors (this holds true for all of the markers disclosed herein). For example, some disc portions 120 could be made in blue, yellow, red, and green. This would allow different shooters to shoot at the target 16 at the same time and to know who hit the target 16. Shooters could compete with one another to see who has the best shots and be able to tell who hit the target 16 and where.

Figure 5C:
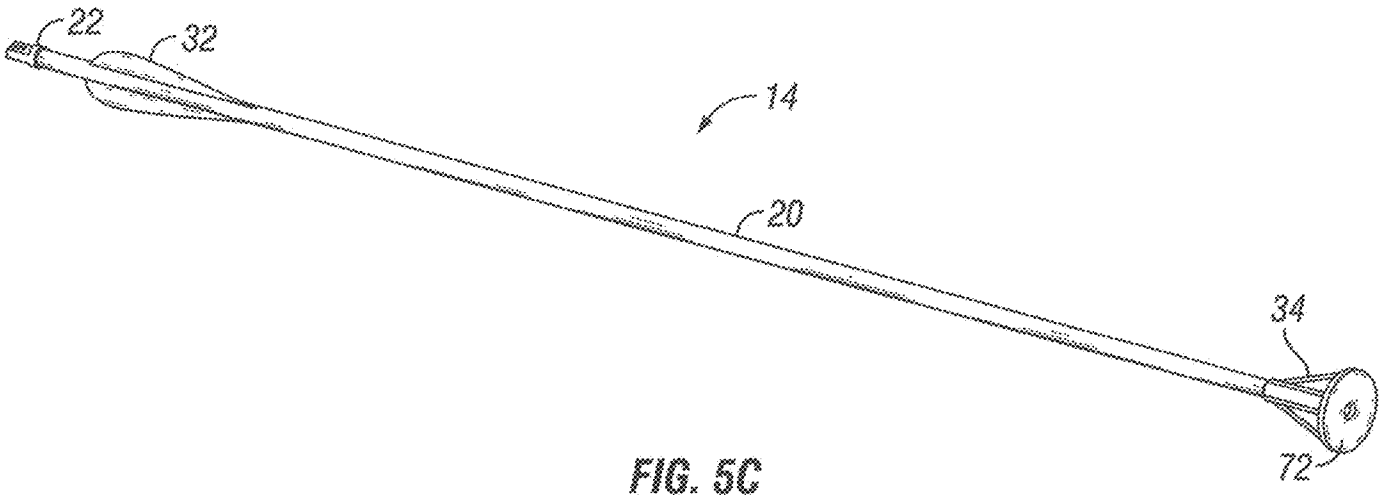
Figure 5D:
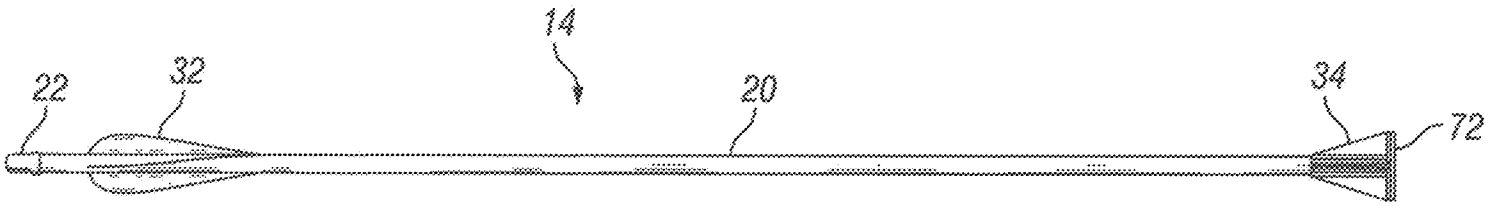
Figure 8:
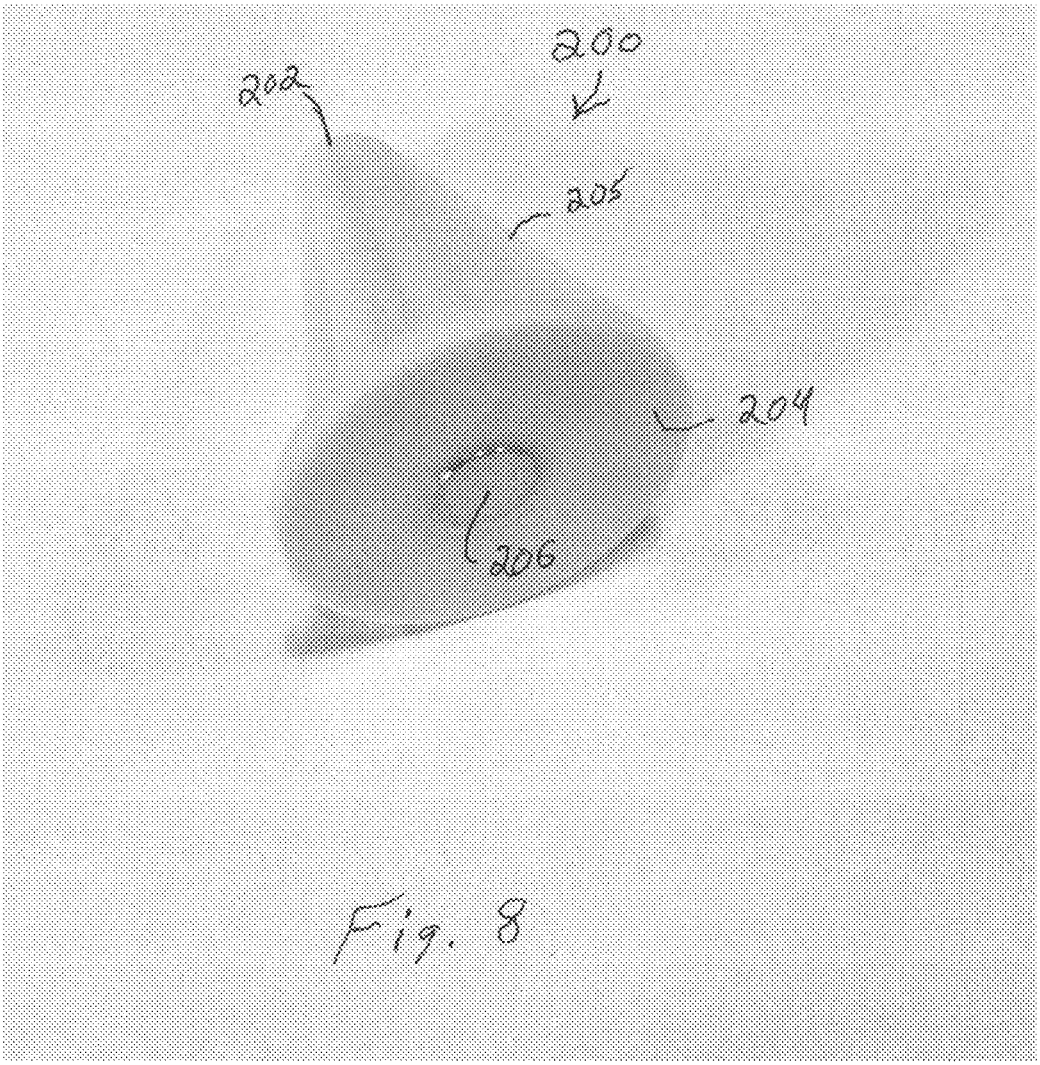
FIG. 8 discloses another embodiment of a blunt.

Referring to FIG. 8, another version of a blunt 200 is disclosed. A rear or distal end of the blunt 200 includes an aperture 202 to receive the shaft 20 (See FIG. 5D) of the arrow 14. A proximate or forward end of the blunt 200 has a circular shaped member 204. A housing 205 is located between the distal end and the proximate end of the blunt 200 for receiving the shaft 20 of the arrow 14 (See FIG. 5D). In one form, in the center of the circular shaped member 204 a first magnet 206 is embedded in the circular shaped member 204.

Figure 9:
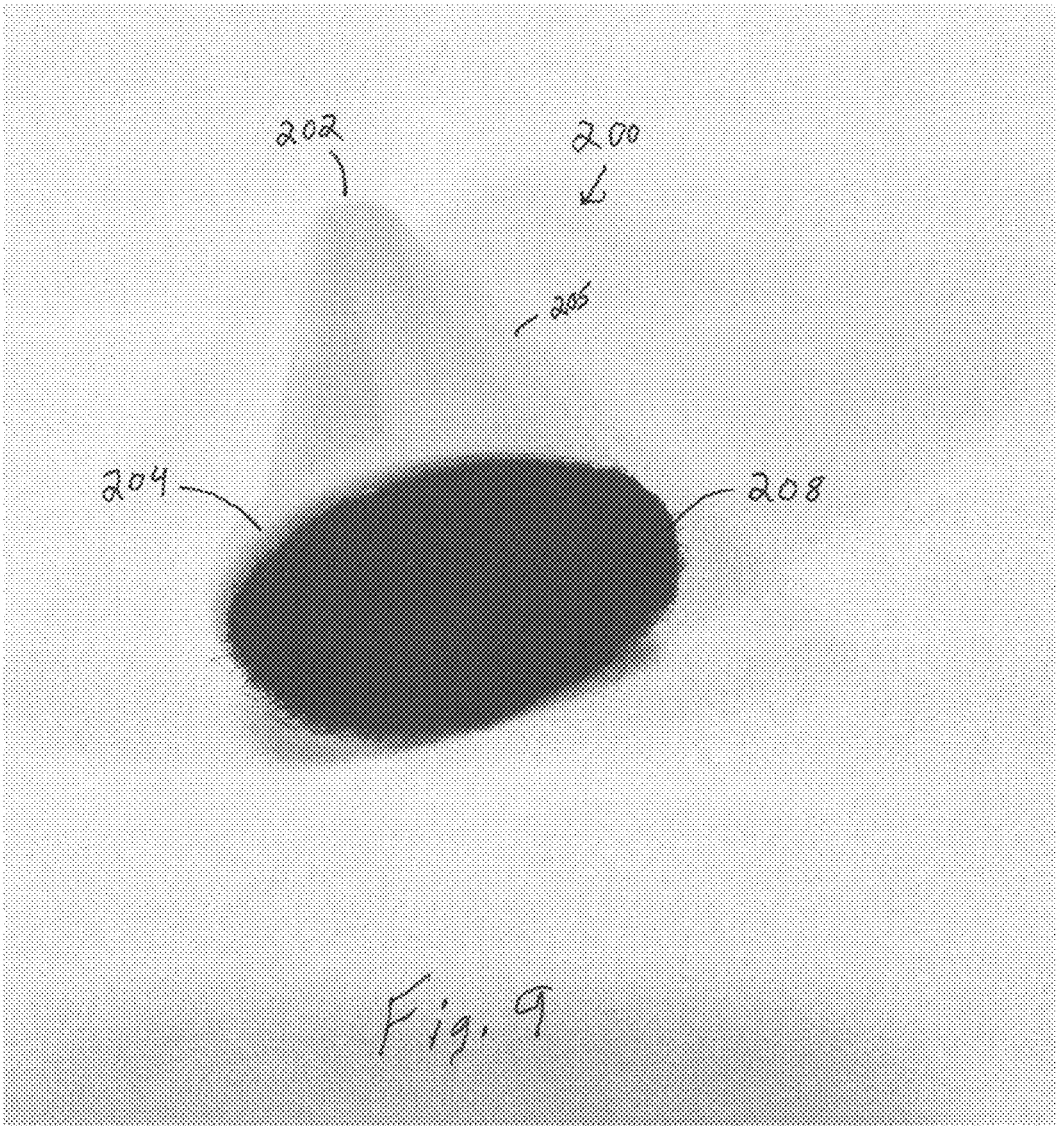
FIG. 9 discloses the blunt set forth in FIG. 8 with a hook and loop pad.
Figure 10:
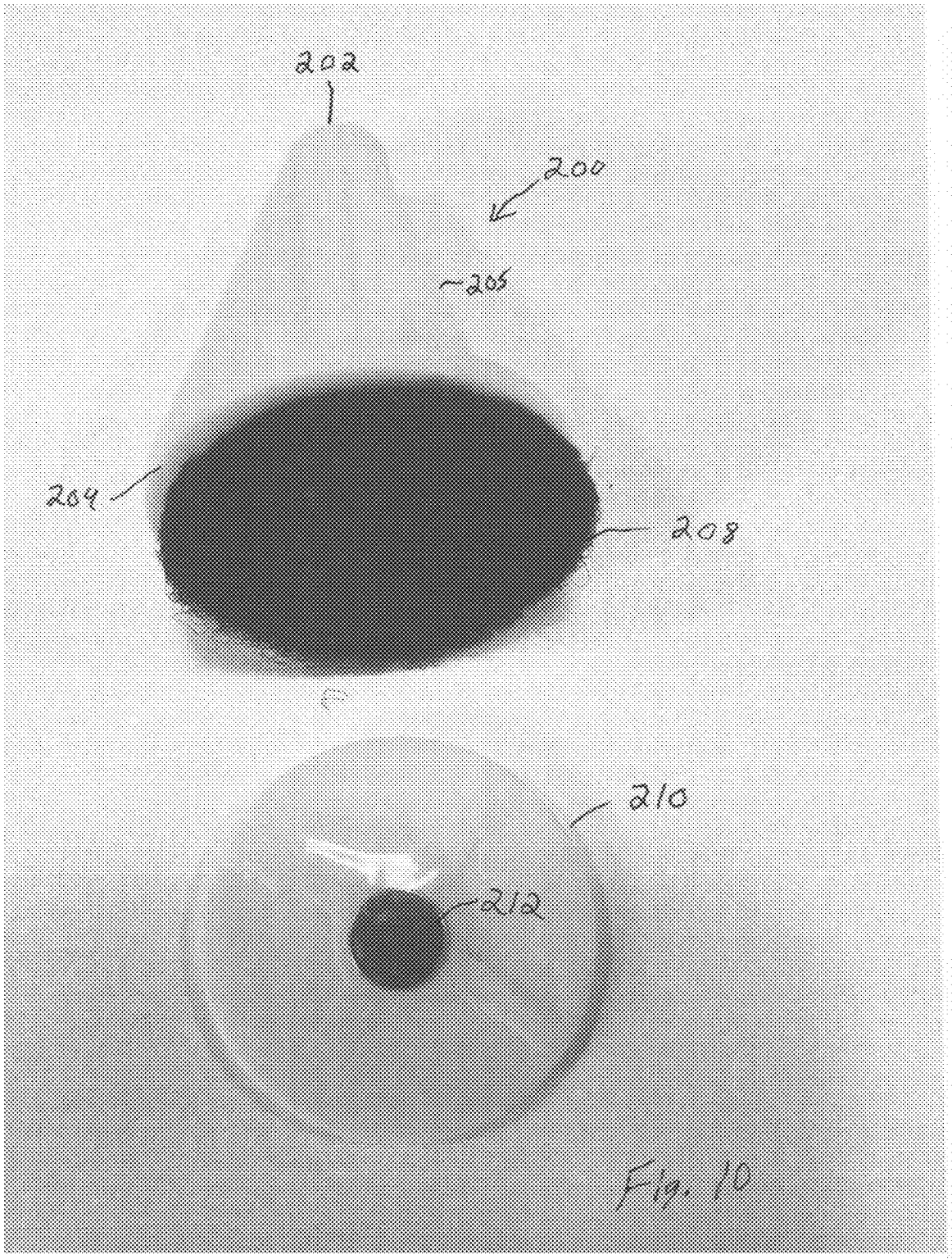
FIG. 10 disclose the blunt set forth in FIG. 9 with a disc added.
Figure 11:
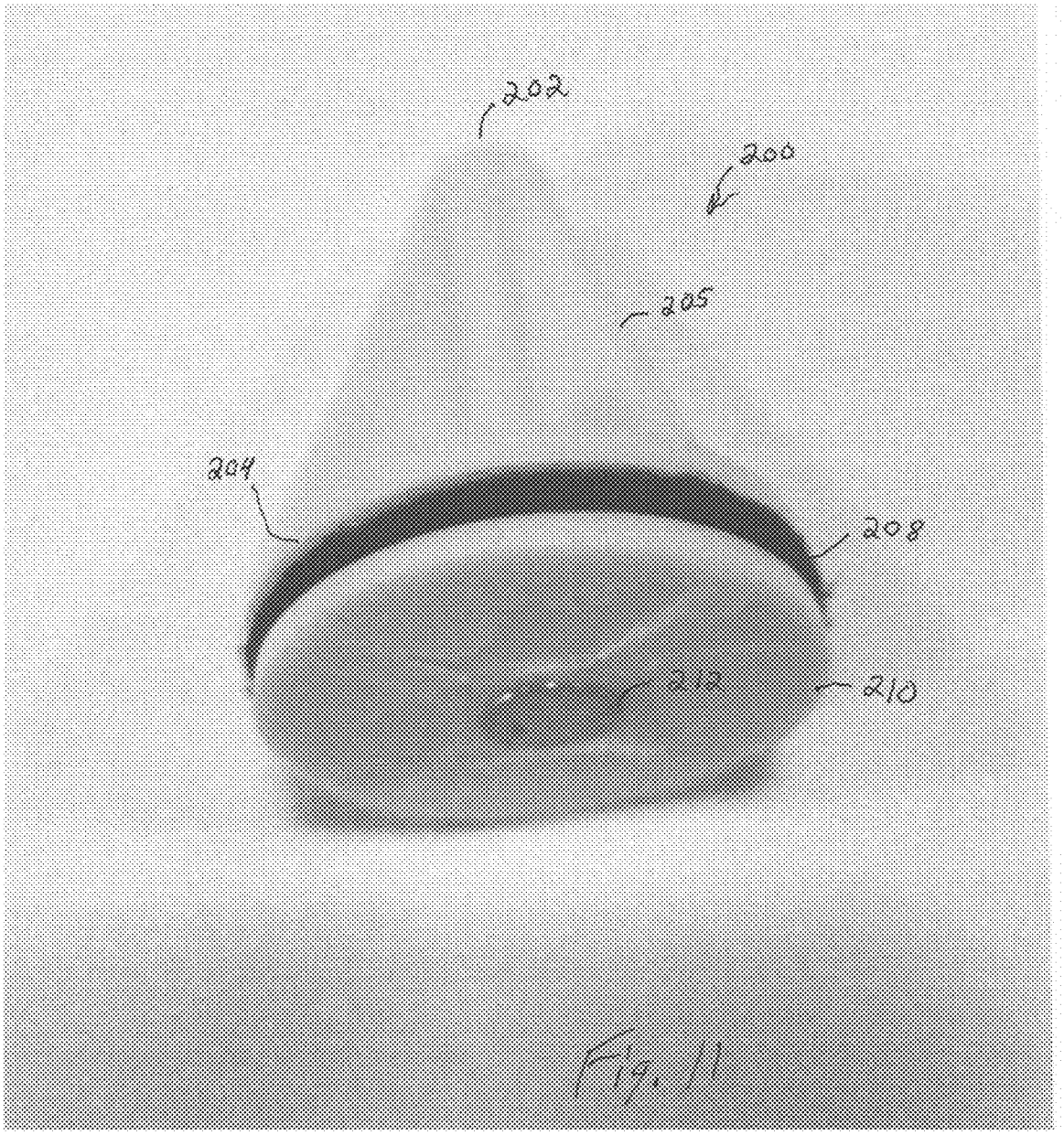
FIG. 11 discloses the blunt set forth in FIG. 10 with the disc removably connected to an upper end of the blunt.
Figure 12:
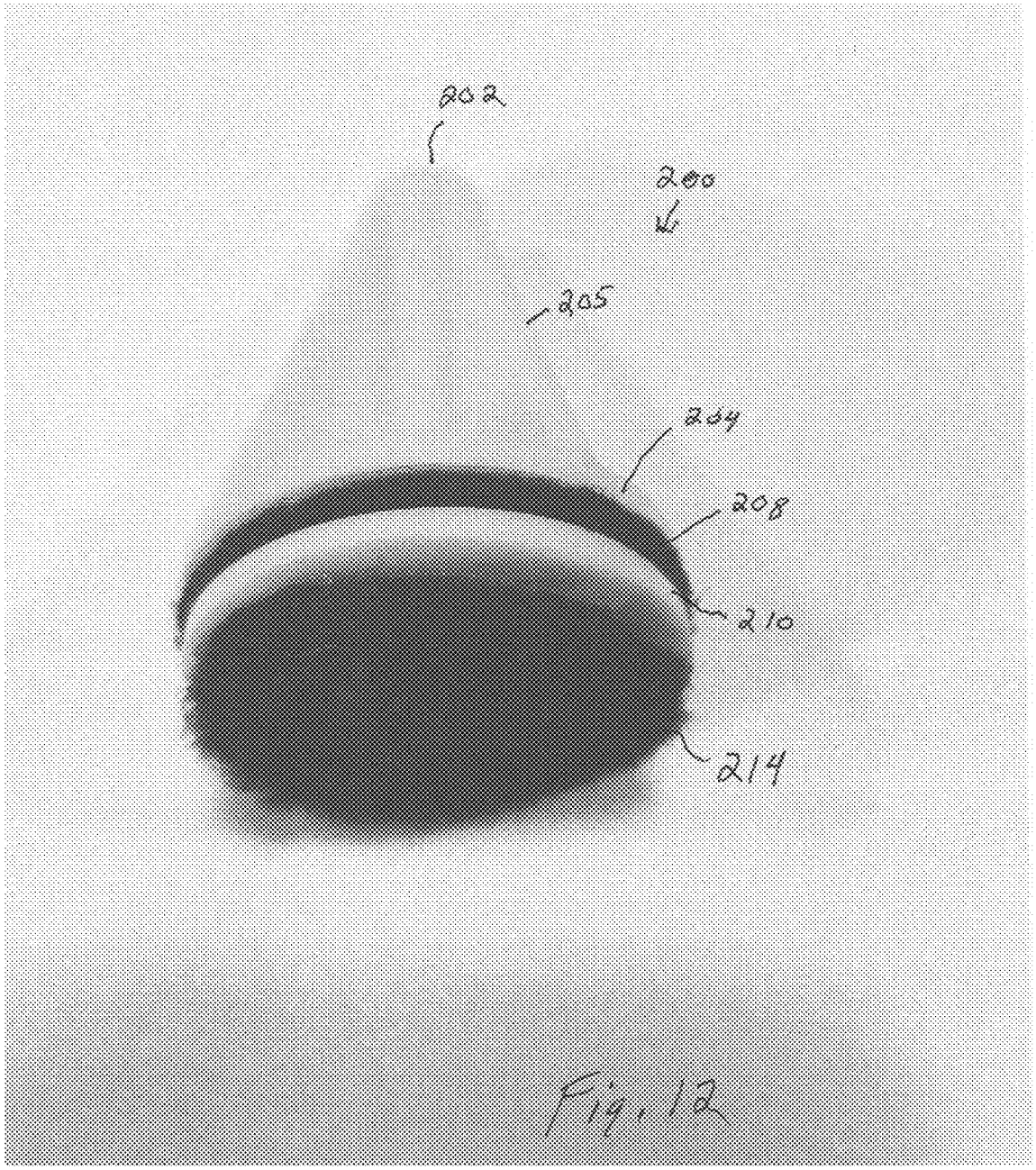
FIG. 12 discloses the blunt set forth in FIG. 11 with a second hook and loop pad connected with an upper surface of the disc.

Referring to FIG. 9, a hook and loop (Velcro®) pad 208 is connected with the circular shaped member 204 of the bunt 200. The back side of the pad 208 includes an adhesive that allows the pad 208 to stick to the circular shaped member 204. Referring to FIGS. 10 and 11, a circular shaped disc 210 is disclosed that includes a metal member 212 located in a central portion of the disc 210. The metal member 212 allows the disc 210 to be releasably connected with the end of the blunt 200 as illustrated in FIG. 11. Referring to FIG. 12, an end of the disc 210 includes a second circular shaped hook and loop pad 214 that is connected with the disc 210. The back side of the second pad 214 includes an adhesive that allows the second pad 214 to stick to the disc 210.

As with the previous embodiments, when the non-lethal arrow 14 (See e.g.—FIGS. 5C and 5D) is shot at the target 16 (See FIG. 6), the second pad 214 causes the disc 210 to be released from the blunt 200 and stick to the target 16. The rest of the non-lethal arrow 14 falls away from the target 16 leaving only the disc 210 stuck to the target 16.

While the use of words such as preferable, preferably, preferred or more preferred utilized in the description indicate that the feature so described may be more desirable, such feature(s) may not be necessary. Embodiments lacking the same are within the scope of the invention as defined by the claims that follow. In reading the claims, it is intended that when words such as "a," "an," "at least one," or "at least one portion" are used there is no intention to limit the claim to only one item unless specifically stated to the contrary in the claim. When the language "at least a portion" and/or "a portion" is used the item can include a portion and/or the entire item unless specifically stated to the contrary.

Although the present invention and its advantages have been described in detail, it should be understood that various changes, substitutions and alterations can be made herein without departing from the spirit and scope of the invention as defined by the appended claims. Moreover, the scope of the present application is not intended to be limited to the particular embodiment of the process, machine, manufacture, composition of matter, means, methods and steps described in the specification. As one of ordinary skill in the art will readily appreciate from the disclosure of the present invention, processes, machines, manufacture, compositions of matter, means, methods, or steps, presently existing or alter to be developed that perform substantially the same function or achieve substantially the same result as the corresponding embodiments described herein may be utilized according to steps.

What is claimed is:

1. A non-lethal arrow, comprising:

a shaft having a non-lethal arrow assembly on a respective end of said shaft;

a nock connected to an opposite end of said shaft;

a marker attached to an end of said non-lethal arrow assembly via a blunt that is configured to stick to a target upon impact with said target and further configured such that said non-lethal arrow disengages from said marker and falls away from said target upon impact with said target leaving only said marker on said target; and wherein said blunt includes an end that includes a magnet, wherein a first hook and loop pad is connected with said end that covers said magnet, wherein said marker includes a disc that includes a metal member positioned on an upper surface of said disc, wherein said metal member of said disc is configured to be removably secured to said blunt by operation of said magnet, and wherein an upper surface of said disc includes a second hook and loop pad.

2. The non-lethal arrow of claim 1, wherein said end of said blunt has a circular shape.

3. The non-lethal arrow of claim 2, wherein said magnet is positioned in a central location of said end.

4. The non-lethal arrow of claim 1, wherein said disc has a circular shape.

5. The non-lethal arrow of claim 1, wherein said first hook and loop pad has a circular shape.

6. The non-lethal arrow of claim 1, wherein said second hook and loop pad has a circular shape.

7. A non-lethal arrow, comprising:

a shaft having a blunt on a respective end of said shaft;

a nock connected to an opposite end of said shaft;

a magnet connected to an end of said blunt;

a first hook and loop pad connected with the end of said blunt covering said magnet; and a disc including a metal member on an upper surface of said disc, wherein said disc is configured to be removably connected with said end of said blunt via placement on said first hook and loop pad, wherein the magnet on the blunt is operable to removably secure the disc to the first hook and loop pad.

8. The non-lethal arrow of claim 7, further comprising a second hook and loop pad connected with an upper surface of said disc.

9. The non-lethal arrow of claim 8, wherein when said non-lethal arrow is shot at a target said second hook and loop pad causes the disc to stick to the target while the rest of the non-lethal arrows falls away from said target.

* * * * *